US006930643B2

(12) United States Patent
Byrne et al.

(10) Patent No.: US 6,930,643 B2
(45) Date of Patent: Aug. 16, 2005

(54) ANTENNA MODULE ASSEMBLY

(75) Inventors: Steven V. Byrne, Burton, MI (US); Loren M. Thompson, Lapeer, MI (US); Randall J. Heidtman, Columbiaville, MI (US); William R. Livengood, Grand Blanc, MI (US); Lynn A. Adams, Owosso, MI (US); Ronald D. Wilcox, Burton, MI (US)

(73) Assignee: Delphi Technologies, Inc., Troy, MI (US)

( * ) Notice: Subject to any disclaimer, the term of this patent is extended or adjusted under 35 U.S.C. 154(b) by 1 day.

(21) Appl. No.: 10/700,105

(22) Filed: Nov. 3, 2003

(65) Prior Publication Data

US 2005/0093755 A1 May 5, 2005

(51) Int. Cl.[7] ..... H01Q 1/24; H01Q 1/32
(52) U.S. Cl. ..... 343/702; 343/713
(58) Field of Search ..... 343/713, 702, 343/715, 700 MS, 711, 725, 872

(56) References Cited

U.S. PATENT DOCUMENTS 4,728,962 A * 3/1988 Kitsuda et al. ..... 343/872
5,568,157 A * 10/1996 Anderson ..... 343/713
5,757,327 A * 5/1998 Yajima et al. ..... 343/713
6,283,375 B1 * 9/2001 Wilz et al. ..... 235/462.45
6,331,838 B1 * 12/2001 Scott et al. ..... 343/715
6,509,878 B1 1/2003 Tornatta, Jr. et al.
6,773,652 B2 * 8/2004 Loy et al. ..... 264/274
6,788,264 B2 * 9/2004 Du ..... 343/725
6,809,686 B2 * 10/2004 Du et al. ..... 343/700 MS
2002/0057792 A1 * 5/2002 Fuhrmann et al. ..... 379/419
2003/0138097 A1 * 7/2003 Fuhrmann et al. ..... 379/428.01
2003/0193440 A1 * 10/2003 Yang ..... 343/711
2004/0017314 A1 * 1/2004 Petropolous ..... 343/700 MS
2004/0183734 A1 9/2004 Noro
2004/0251307 A1 * 12/2004 Schmidh et al. ..... 235/462.46

FOREIGN PATENT DOCUMENTS

DE 295 00 961 6/1995
EP 0 862 239 9/1998

OTHER PUBLICATIONS

European Search Report dated Dec. 29, 2004.

* cited by examiner

*Primary Examiner*—Don Wong
*Assistant Examiner*—Hung Tran Vy
(74) *Attorney, Agent, or Firm*—Stefan V. Chmielewski

(57) ABSTRACT

A fastening structure for an antenna module assembly is disclosed. The fastening structure for an assembly includes a cover, a gasket inner seal, a circuit board including at least one antenna element, and a base. The gasket inner seal is placed over the circuit board. The gasket inner seal and circuit board are intermediately located between the cover and the base. The base includes a plurality of beveled snap-tab receiving portions integrally located about a base perimeter. The beveled snap-tab receiving portions engage an inner perimeter of the cover defined by flexible snap-tabs to fasten and matingly secure the cover to the base.

16 Claims, 6 Drawing Sheets

ANTENNA MODULE ASSEMBLY

TECHNICAL FIELD

The present invention generally relates to antenna module assemblies and, more particularly, to an improved fastening structure for an antenna module assembly.

BACKGROUND OF THE INVENTION

As seen in FIG. 1, a conventional antenna module assembly, which is seen generally at 1, includes a circuit board 2, a base 3, and a cover 4. It is has been common practice in the art to mount, maintain, and seal the antenna module assembly 1 with a plurality of upper screws 5*a* and lower screws 5*b*. The upper screws 5*a* pass downward through the circuit board 2 and into the base 3, and lower screws 5*b* pass upward from the bottom of the base 3 into the cover 4. The screws 5*a*, 5*b* also function in grounding the circuit board 2 to the base 3 for capacitive coupling.

Although adequate for most applications, conventional antenna module assemblies 1 have inherent disadvantages. Firstly, the inclusion of the screws 5*a*, 5*b* increase cost, assembly labor and introduce inherent quality problems. Secondly, in some designs, metal screws 5*a*, 5*b* act as obstructions, which creates nulls in the gain pattern because the antenna located on the circuit board 2 may not be able to see through the head of each screw 5*a*, 5*b* extending above the plane of the circuit board 2. Thirdly, because screws 5*a*, 5*b* are applied in the design of the antenna module assembly 1, the perimeter of the module, which is seen generally at 6, is increased to accommodate the passage of the screws, particularly the lower screws 5*b* that pass upwardly into the cover 4. Aside from additional material called for in the design of the antenna module assembly 1 about the perimeter 6, the antenna module assembly 1 itself occupies a larger surface area of a surface it is mounted on, such as, for example, the roof of an automotive vehicle (not shown). From an aesthetic perspective, this particular design for an antenna module assembly 1 is undesirable for original equipment manufacturer (OEM) applications because it may negatively effect automotive roof design or trimming issues. Even further, because the antenna module assemblies 1 may be applied onto different roofs having different contours, the antenna module assemblies 1 may not be universally applied to all vehicles, which would otherwise result in a gap between the antenna module assembly 1 and the roof.

Accordingly, it is therefore desirable to provide an improved antenna module assembly that eliminates the use of applied fasteners to improve antenna performance while also decreasing assembly labor, component cost and quality problems. It is also desirable to provide an improved antenna module assembly that decreases the size of and materials used in manufacturing the module such that the module may be applied to a variety of vehicles, negating the concern of alternate roof design or trimming issues.

SUMMARY OF THE INVENTION

The present invention relates to a fastening structure for an antenna module assembly. Accordingly, one embodiment of the invention is directed to a fastening structure for an antenna module assembly that includes a cover, a gasket inner seal, a circuit board including at least one antenna element, and a base. The gasket inner seal is placed over the circuit board. The gasket inner seal and circuit board are intermediately located between the cover and the base. The base includes a plurality of beveled snap-tab receiving portions integrally located about a base perimeter. The beveled snap-tab receiving portions engage an inner perimeter of the cover defined by flexible snap-tabs to fasten and matingly secure the cover to the base.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
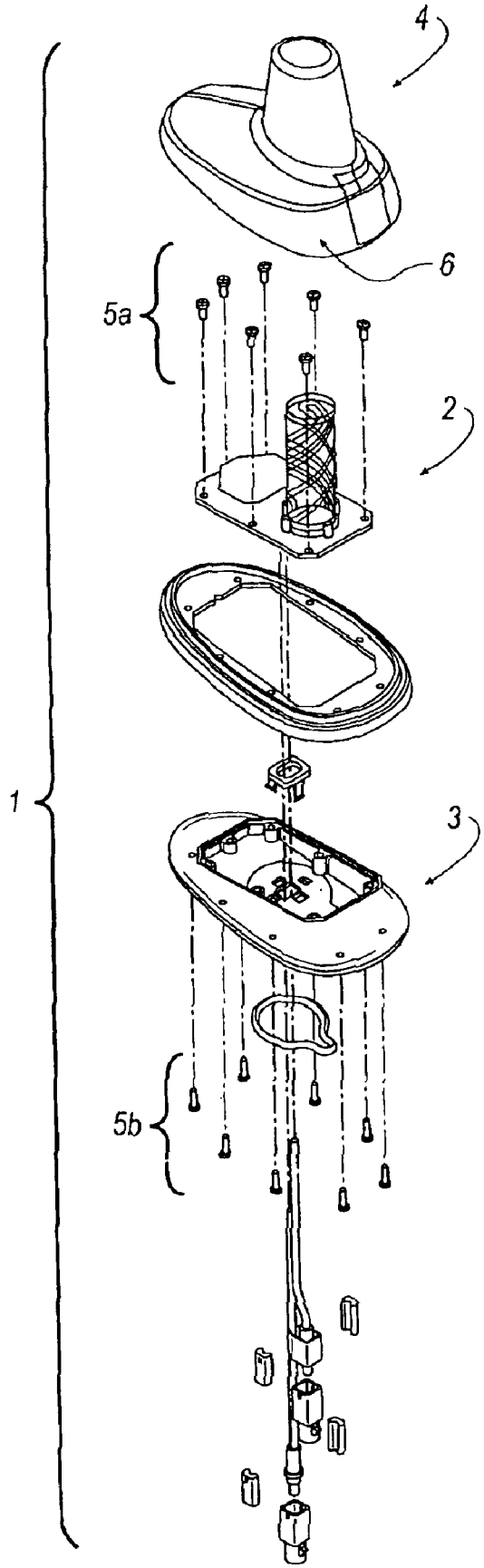
FIG. 1 (PRIOR ART)
FIG. 1 illustrates an exploded view of a conventional antenna module assembly.
Figure 2:
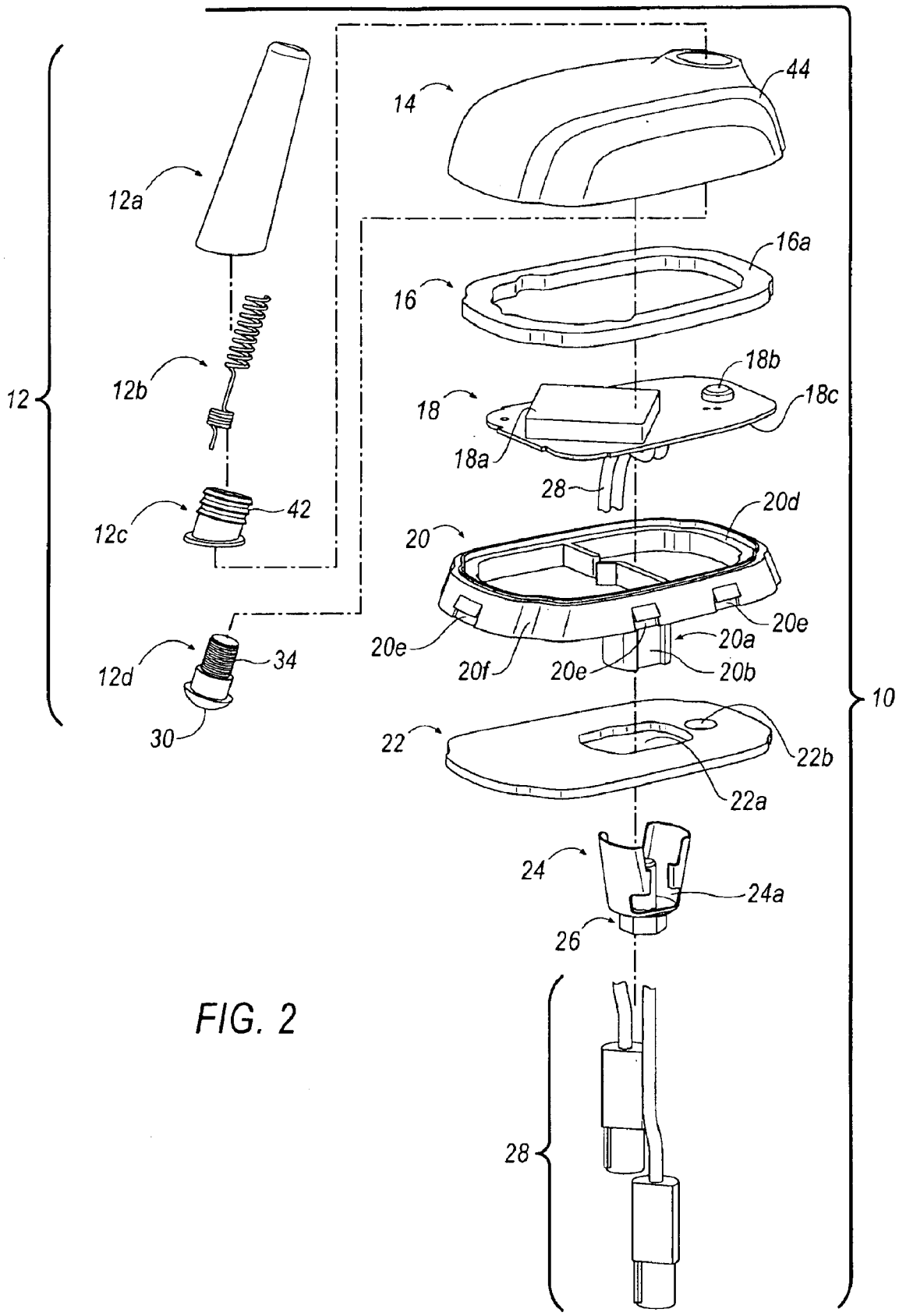
FIG. 2 illustrates an exploded view of an antenna module assembly according to one embodiment of the invention.
Figure 3:
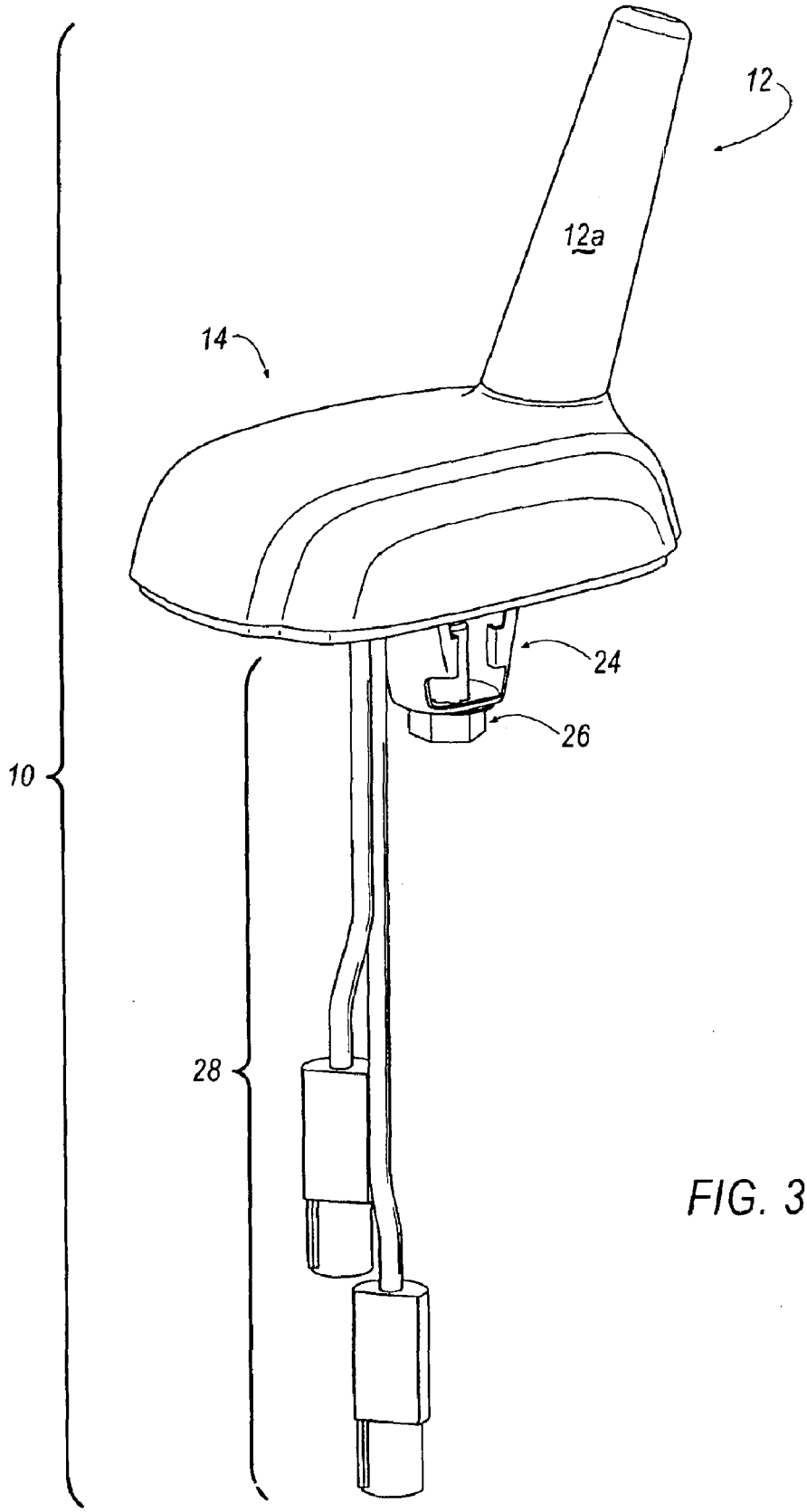
FIG. 3 illustrates an assembled view of the antenna module assembly according to FIG. 2.
Figure 4:
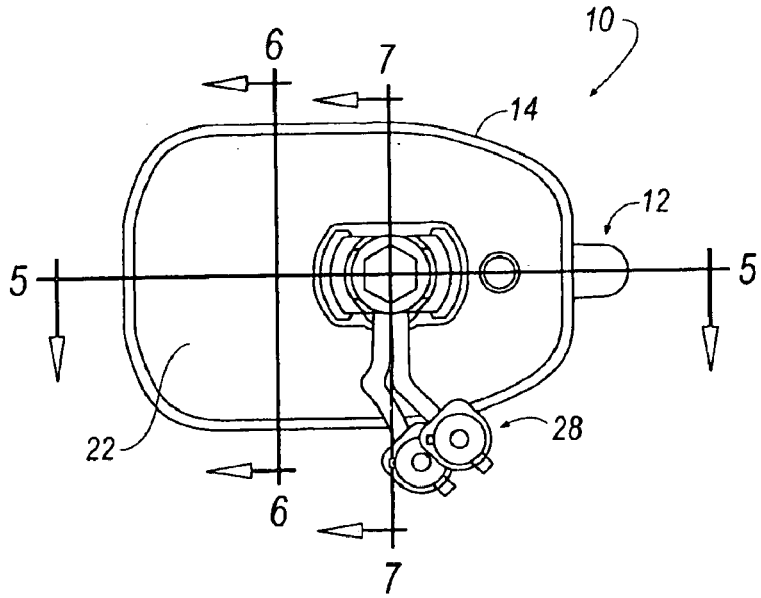
FIG. 4 illustrates a bottom view of the antenna module assembly according to FIG. 3.

The above described disadvantages are overcome and a number of advantages are realized by the inventive antenna module assembly, which is generally illustrated at 10 in FIGS. 2–4. The antenna module assembly 10 includes a mast assembly, which is seen generally at 12, that includes an antenna housing 12*a*, a first antenna element 12*b*, such as a mast antenna element, an antenna mast screw 12*c*, and a threaded metallic stud 12*d*. The antenna module assembly 10 also includes a cover 14, a gasket inner seal 16, a circuit board 18 carrying a second antenna element 18*a*, a base 20, a gasket outer seal 22, a retaining clip 24, which is secured about a locating boss 20*a* by a screw 26, and wire leads 28, which are connected to and extend from the circuit board 18.

Although illustrated in a broken view, the wire leads 28 extend through a base side-passage 20*b* and an outer gasket seal passage 22*a*, exiting through a retaining clip lower-side passage 24*a*. The gasket outer seal 22 also includes a secondary passage, which is seen generally at 22*b*, that receives an alignment boss 20*c* (FIG. 5) extending from a lower side of the base 20 that extends through a metallic surface, M (FIG. 5), such as the roof of a vehicle, to prevent rotation of the antenna module assembly 10 about a common axis, A (FIG. 5), which is illustrated through the a common axis of the screw 26. Because the surface, M, is metallic, capacitive coupling is provided for the antenna elements 12*b*, 18*a*.

As seen in FIG. 2, the first antenna element 12*b* may be shaped into any desirable antenna to receive any desired frequency. For example, the illustrated first antenna element 12*b* in FIG. 2 includes a pair of coiled sections that are intermediately located between a straight-wire section to receive telephone signals, such as analog mobile phone service (AMPS) signals, which operate on the 824–849 MHz and 869–894 MHz bands, and personal communication systems (PCS) signals, which operate on the 1850–1910 and 1930–1990 MHz bands.

Other antennas may be applied in the design of the antenna module assembly 10 as well. For example, the second antenna element 18*a*, such as a ceramic patch antenna element, is shown on the circuit board 18. The ceramic patch antenna element 18*a* may receive satellite digital audio radio signals (SDARS), which operates on the 2.32–2.345 GHz band, or alternatively, receive commercial global positioning (GPS) signals, which operates on the 1560–1590 MHz band. If multiple signal band reception is desired, the antenna module assembly 10 may be designed to accommodate multiple ceramic patch antenna elements 18*a*. For example, one possible implementation of the antenna module assembly 10 may include the first antenna element 12*b* located in the mast assembly 12, and two ceramic patch antenna elements 18*a* located on the circuit board 18 to receive AMPS/PCS, SDARS, and GPS signals, respectively. Although not shown, other possible antenna designs that function on any other desirable band may be included in the design of the antenna module assembly 10. For example, digital audio broadcast (DAB) signal, which operates on the 1452–1492 MHz band, may also be included as well.

The cover 14 may include any desirable plastic material, such as a polycarbonate (PC) blend or Polycarbonate-Acrylnitril-Butadien-Styrol-Copolymere (PC/ABS) blend, that is weatherable and durable. For example, one possible embodiment of the invention may include a PC blend that is commercially available and sold under the trade name Geloy™ from General Electric Company Corporation of New York, N.Y. The gasket inner seal 16 preferably comprises a layered structure, such as a three layer structure including a core layer that is laminated on its upper side and lower sides. The core layer is preferably a rigid plastic material, such as polypropylene (PP), and the laminated layers are preferably a pliable material, such as a silicon foam or rubber, that is conformable such that over-travel of the gasket does not negatively effect the seal of the antenna module assembly 10. Alternatively, the gasket inner seal 16 may comprise a single core layer comprising foam with an adhesive layer applied to the upper and lower sides of the foam such that the gasket inner seal 16 is prevented from moving inside of the antenna module assembly 10 from its desired position over the base 20 such that the outer perimeter of the gasket inner seal is within at least 1 mm of the inner wall perimeter of the cover 14.

Figure 5:
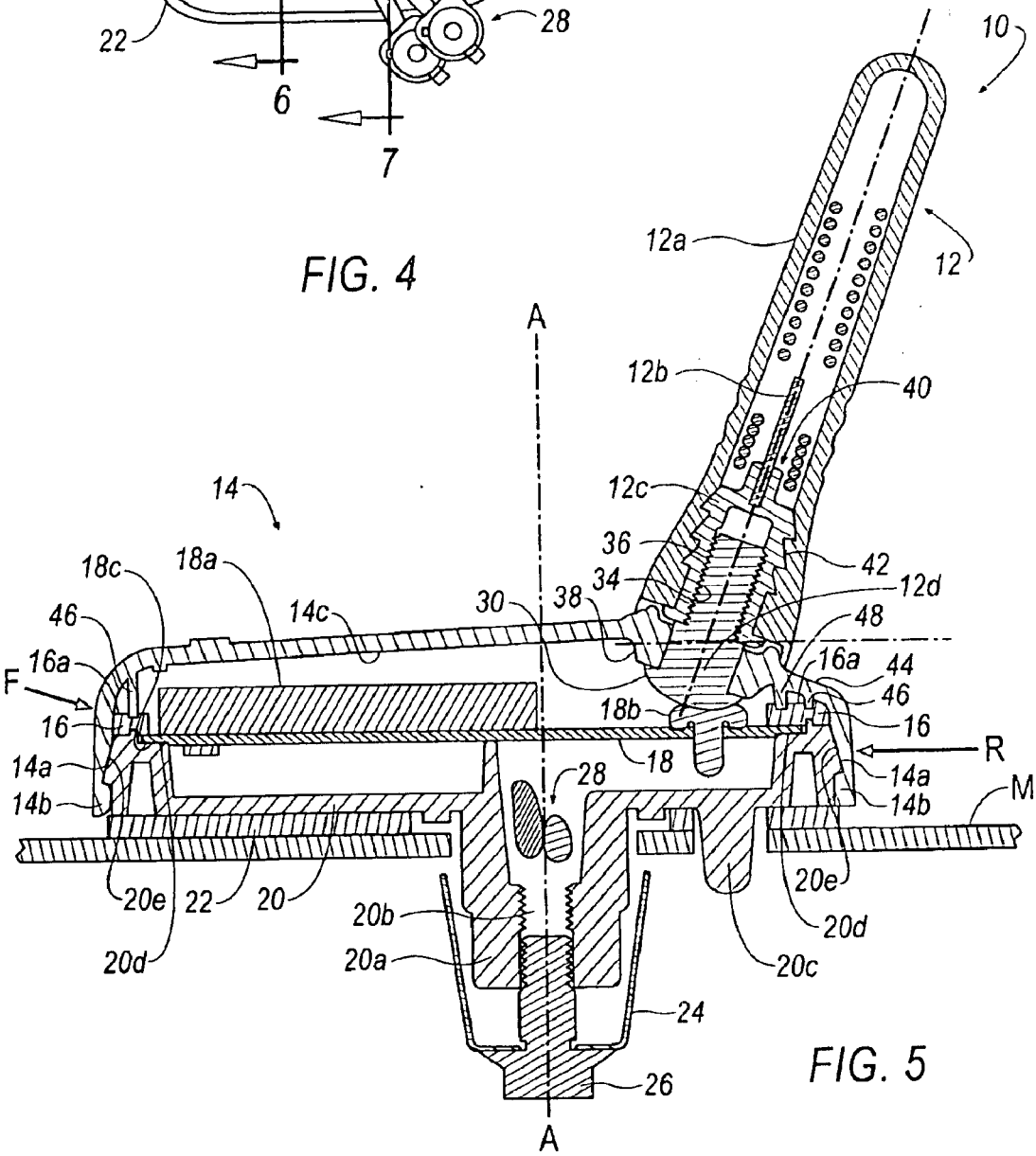
FIG. 5 illustrates a cross-sectional view of the antenna module assembly according to FIG. 4 taken along line 5—5.

Referring now to FIG. 5, a head portion 30 of the threaded metallic stud 12*d* is in contact with a conductive elastomeric contact member 18*b* that is located on and provides communication of signals to the circuit board 18. The metallic stud 12*d* includes a threaded portion 34 that extends from the cover 14 such that a threaded inner bore perimeter 36 of the antenna mast screw 12*c* may retain and depress the head portion 30 into an inner beveled portion 38 of the cover 14. Alternatively, rather than being threadingly engaged by the antenna mast screw 12*c*, the metallic stud 12*d* may be in-molded with the cover 14, ultrasonically staked into the cover 14, glued, or press-fitted into the cover 14. Upon securing the antenna mast screw 12*c* about the metallic stud 12*d*, the first antenna element 12*b* is located in an antenna element receiving portion 40 of the antenna mast screw 12*c*. Then, upon placement of the first antenna element 12*b*, the antenna housing 12*a* is secured to an outer threaded portion 42 of the antenna mast screw 12*c*, such that the antenna housing 12*a* is located about an outer beveled portion 44 of the cover 14.

Once the mast assembly 12 is secured to the cover 14, the gasket inner seal 16 and circuit board 18 are intermediately located between the cover 14 and the base 20. The base 20 is conductive, comprising any desirable metallic material, such as a casted zinc or brass, which may be subsequently plated. For example, one embodiment of the invention may include a base 20 comprising zinc with a trivalent plating. Functionally, the base 20 retains the circuit board 18 about a base shoulder 20*d* such that the base shoulder 20*d* adjacently opposes a grounding strip 18*c* located about the perimeter of the circuit board 18 for electrical coupling.

As best seen in FIGS. 2 and 5, the base 20 includes a plurality of beveled snap-tab receiving portions 20*e* integrally located about a base perimeter 20*f*. The beveled snap-tab receiving portions 20*e* are designed to engage an inner perimeter 14*a* of the cover 14 defined by flexible snap-tabs 14*b* to fasten and matingly secure the cover 14, gasket inner seal 16, circuit board 18, and base 20 of the antenna module assembly 10. Essentially, as the cover 14 slides over the base 20, the snap-tabs 14*b* momentarily flex outwardly and then return back inwardly in the reverse direction once the snap-tabs 14*b* have cleared the snap-tab receiving portions 20*e* of the base 20. Any desirable number of snap-tabs 14*b* and snap-tab receiving portions 20*e* may be implemented in the invention; for example, the illustrated embodiment includes a pair of snap-tabs 14*b* and snap-tab receiving portions 20*e* on longitudinal sides of the antenna module assembly 10 and a single snap-tab 14*b* and snap-tab receiving portion 20*e* located at a front and rear end of the antenna module assembly 10. Although not illustrated, the location of the snap-tabs 14 and snap-tab receiving portions 20*e* may be flip-flopped from the cover 14 and base 20, respectively. Even further, although individual snap-tabs 14 and snap-tab receiving portions 20*e* are shown, the invention may alternatively include a single continuous, perimeter-shaped snap tab 14 located about the inside perimeter of the cover 14 and a single continuous snap-tab receiving portion 20*e* located about the outer perimeter of the base 20.

Figure 7:
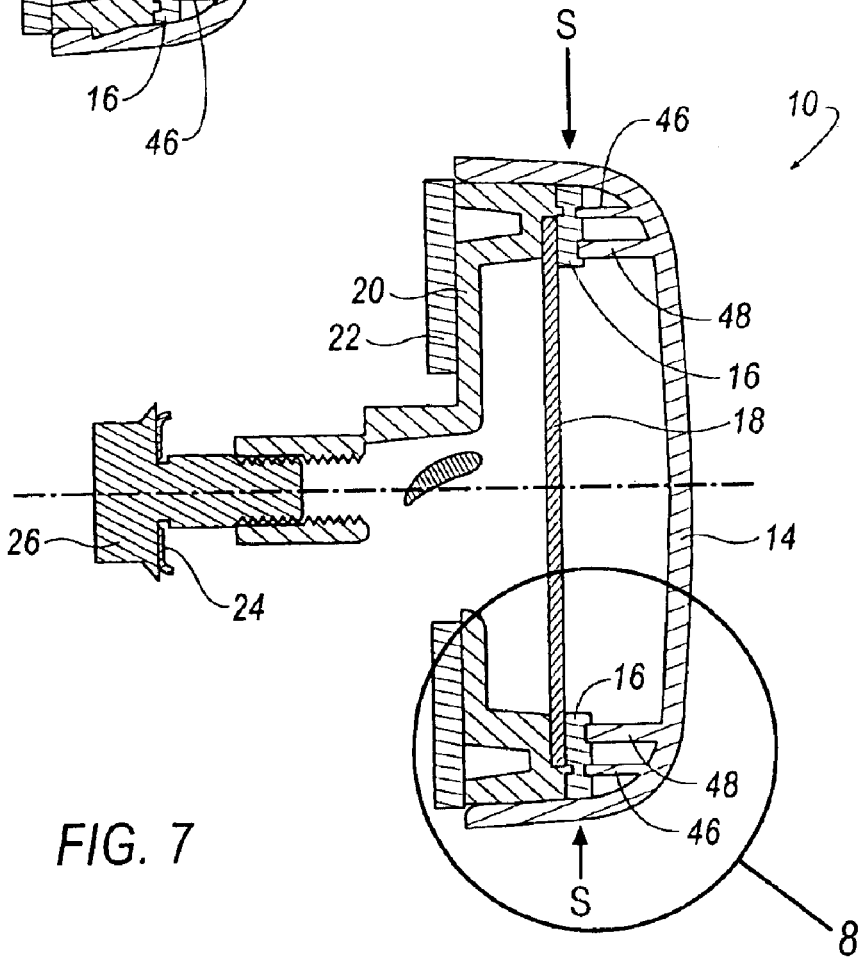
FIG. 7 illustrates another cross-sectional view of the antenna module assembly according to FIG. 4 taken along line 7—7.
Figure 8:
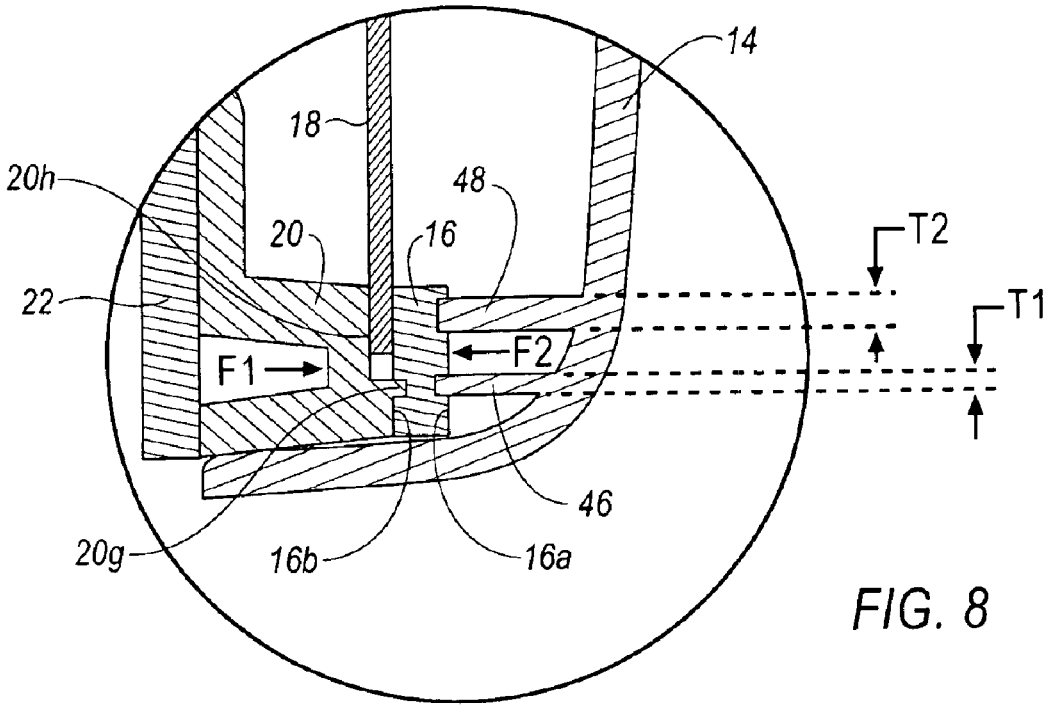
FIG. 8 illustrates a magnified view of the antenna module assembly according to FIG. 7.
Figure 9:
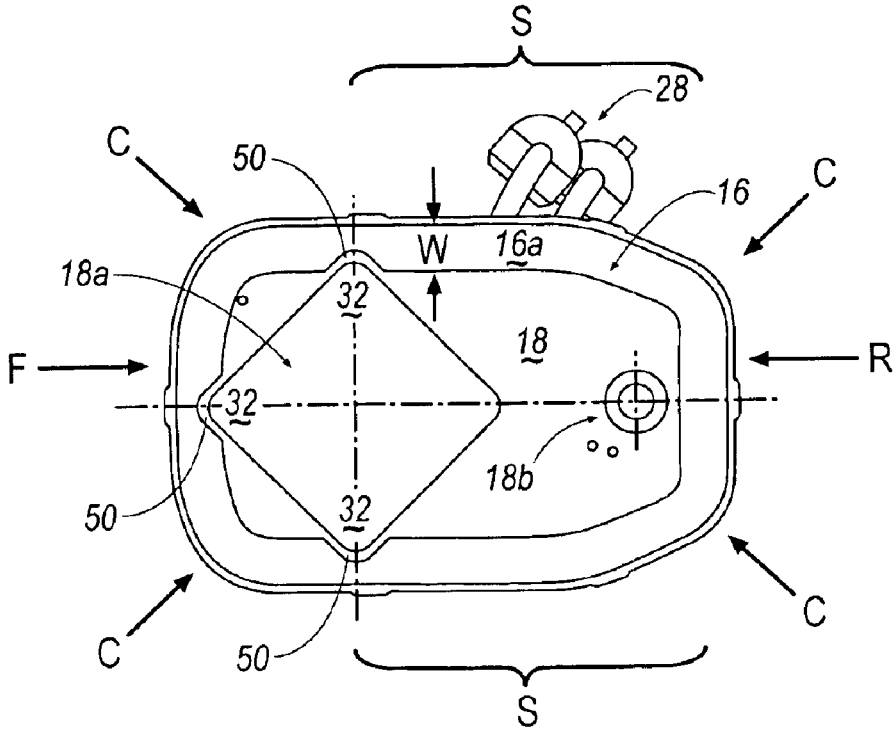
FIG. 9 illustrates a top view of the antenna module assembly with the cover removed.

To provide a secured sealing assembly against moisture or contaminant ingress that may effect operation of components on the circuit board 18, the cover 14 includes ribs, which are seen generally at 46 and 48, that are located about the perimeter of the antenna module assembly 10. The ribs 46, 48 generally extend downwardly from a cover top portion 14*c* and bite into an upper portion 16*a* of the gasket inner seal 16. As seen in FIGS. 5–8, the ribs 46, are hereinafter referred to as outboard ribs 46 and the ribs 48 are hereinafter referred to as inboard ribs 48. The outboard ribs 46 are generally located about the entire perimeter of the cover 14. To further reduce the overall packaging size of the antenna module assembly 10, the overall perimeter width, W (FIG. 9), of the gasket inner seal 16 varies and affects the pattern of the placement of the inboard ribs 48 that bite into the upper portion 16*a*. Referring initially to FIGS. 5 and 8, the inboard ribs 48 are generally located about a rear end perimeter, R, of the cover 14 where the mast assembly 12 is located, which is opposite to a front end perimeter, F. As illustrated in FIGS. 7 and 9, the inboard ribs 48 are also generally located about two side portion perimeters, S. Although not illustrated in cross-sectional view, the inboard ribs 48 are also located about corner perimeter portions, C (FIG. 9).

As explained above in relation to reducing the overall packaging of the antenna module assembly 10, corners 32

Figure 6:
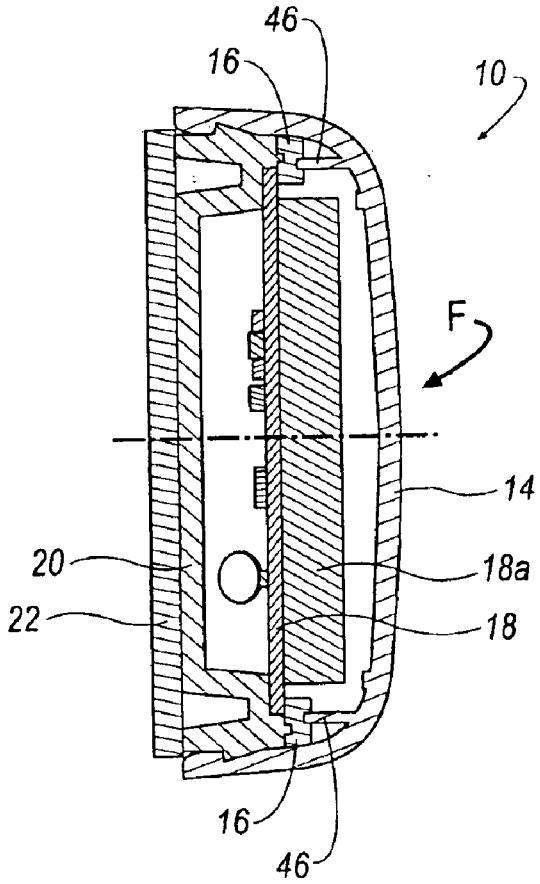
FIG. 6 illustrates another cross-sectional view of the antenna module assembly according to FIG. 4 taken along line 6—6.

(FIG. 9) of the ceramic patch antenna element 18*a* extend into recesses, which are generally seen at 50, of the gasket inner seal 16; thus, referring to FIGS. 5 and 6, the inboard ribs 48 may not be continuous about the cover 14 perimeter proximate to the recesses 50 of the gasket inner seal 16, which defines the overall perimeter width, W, variation, as explained above. Therefore, to accommodate the corners 32 of the ceramic patch antenna element 18*a*, the inboard ribs 48 are altered such that only the outboard ribs 46 bite into the upper portion 16*a* of the gasket inner seal 16 near the recesses 50. Although it is preferable to maintain inboard ribs 48 about the entire perimeter of the cover 14, it is contemplated that overall packaging size may be desirably reduced by discontinuing the rib pair pattern of the outboard and inboard ribs 46, 48 at least where the corners 32 of the ceramic patch antenna element 18*a* extend into the gasket inner seal 16.

Referring specifically now to FIG. 8, an additional rib perimeter comprising lower ribs 20*g* extend upwardly from a base top portion 20*h* and bites into a lower portion 16*b* of the gasket inner seal 16 in an opposing relationship with respect to the ribs 46, 48 that bites into the upper portion 16*a* of the gasket inner seal 16. Here, the outboard and inboard rib pair 46, 48 is further defined to include a first thickness, T1, and a second thickness, T2. More specifically, the first thickness, T1, is related to the outboard rib 46, and the second thickness, T2, is related to the inboard rib 48. As illustrated, the thickness, T1, of the outboard rib 46 is less than the thickness, T2, of the inboard rub 48. Although the inboard rib 48 includes a greater thickness, T2, than the thickness, T1, of the outboard rib 46, any desirable thickness, T1, T2, may be chosen in the design of the ribs 46, 48. One embodiment of the invention may include thicknesses of T1 and T2 that are approximately equal to 0.60 mm and 1.00 mm, respectively. As illustrated, the outboard rib 46 generally opposes the lower ribs 20*g* and function in providing opposing upward and downward forces about the gasket inner seal 16, which is generally illustrated at arrows F1, F2, while the inboard ribs 48 cooperate in providing additional downward force, F2, such that the gasket inner seal 16 is pressed against the circuit board 18, permitting the circuit board 18 to be grounded and capacitively coupled.

Accordingly, an improved antenna module assembly 10 is provided and eliminates the use of applied fasteners, such as metallic screws, to improve antenna performance and quality while also decreasing assembly labor and component cost. The antenna module assembly 10 may also be decreased in size about its overall perimeter by providing mating sets of flexible snap-tabs 14*b* and snap-tab receiving portions 20*e* about the cover 14 and base 20 such that the ribs 46, 48, and 20*g* extending from the cover 14 and base 20 engages the inner gasket seal 16. As a result of reducing the overall packaging size of the antenna module assembly 10, the antenna module assembly 10 may be applied to a variety of vehicles, negating the concern of alternate roof design or trimming issues of a vehicle.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A fastening structure for an antenna module assembly, comprising:

a cover, a gasket inner seal, a circuit board including at least one antenna element, and a base, wherein:

the gasket inner seal is placed over the circuit board, and wherein the gasket inner seal and circuit board are intermediately located between the cover and the base, said cover and base define fastenerless means to effect snap engagement thereof, and said cover and base further define opposed features selectively extending about the perimeters thereof to compressively engage said gasket inner seal to effect a peripheral water-tight interconnection there between and to simultaneously resiliently urge said circuit board into a predetermined design location within a cavity formed by said cover and base.

2. The fastening structure for an antenna module assembly according to claim 1, wherein the base retains the circuit board about a base shoulder such that the base shoulder adjacently opposes a grounding strip located about the perimeter of the circuit board for electrical coupling.

3. The fastening structure for an antenna module assembly according to claim 1, wherein the cover includes outboard ribs and inboard ribs that are located about a front end perimeter, a rear end perimeter, a side perimeter, and a corner perimeter of the antenna module assembly.

4. The fastening structure for an antenna module assembly according to claim 3, wherein the outboard ribs and inboard ribs extend downwardly from a cover top portion and bite into an upper portion of the gasket inner seal.

5. The fastening structure for an antenna module assembly according to claim 4, wherein an additional rib perimeter comprising lower ribs extend upwardly from a base top portion bites into a lower portion of the gasket inner seal in an opposing relationship with respect to the outboard and inboard ribs that bites into the upper portion of the gasket inner seal.

6. The fastening structure for an antenna module assembly according to claim 3, wherein the outboard ribs are further defined to include a first thickness and wherein the inboard ribs are further defined to include a second thickness, wherein the first thickness is less than the second thickness.

7. The fastening structure for an antenna module assembly according to claim 1 wherein the at least one antenna element is a mast antenna element.

8. A fastening structure for an antenna module assembly according to claim 7, wherein the at least one antenna element further comprises at least one patch antenna element, wherein the mast antenna element and the at least one patch antenna element receives AMPS/PCS signals, SDARS signals, GPS signals, and DAB signals.

9. The fastening structure for an antenna module assembly according to claim 1 further comprising a gasket outer seal, a retaining clip secured about a locating boss by a screw, and wire leads, which are connected to and extend from the circuit board.

10. The fastening structure for an antenna module assembly according to claim 9, wherein the gasket outer seal also includes a secondary passage that receives an alignment boss extending from a lower side of the base that extends through a metallic surface to prevent rotation of the antenna module assembly about a common axis.

11. The fastening structure for an antenna module assembly according to claim 1, wherein the cover includes a Polycarbonate blend or a Polycarbonate-Acrylnitril-Butadien-Styrol-Copolymere blend.

12. The fastening structure for an antenna module assembly according to claim 1, wherein the gasket inner seal includes a three layer structure including a core layer that is laminated on a core upper side and a core lower side.

13. The fastening structure for an antenna module assembly according to claim 12, wherein the core layer is Polypropylene and the laminated layers are a silicon foam or rubber.

14. The fastening structure for an antenna module assembly according to claim 1, wherein the gasket inner seal includes a single core layer comprising foam with an adhesive layer applied to the upper and lower sides of the foam.

15. The fastening structure for an antenna module assembly according to claim 1, wherein the base includes a plated, casted metallic material.

16. The fastening structure for an antenna module assembly according to claim 15, wherein the base includes zinc with a trivalent plating.

* * * * *